US006695304B1

(12) United States Patent
Werner

(10) Patent No.: US 6,695,304 B1
(45) Date of Patent: Feb. 24, 2004

(54) VIBRATING MEANS FOR ALIGNING ENVELOPES IN A HOPPER

(75) Inventor: Todd C. Werner, St. Pete Beach, FL (US)

(73) Assignee: Pitney Bowes Inc., Stamford, CT (US)

( * ) Notice: Subject to any disclaimer, the term of this patent is extended or adjusted under 35 U.S.C. 154(b) by 69 days.

(21) Appl. No.: 10/064,530

(22) Filed: Jul. 24, 2002

Related U.S. Application Data

(63) Continuation-in-part of application No. 09/712,716, filed on Nov. 14, 2000.

(51) Int. Cl.[7] ..... B65H 3/62
(52) U.S. Cl. ..... 271/146; 271/3.02; 271/210
(58) Field of Search ..... 271/3.01, 3.02, 271/3.05, 131, 137, 138, 133, 146, 210, 196

(56) References Cited

U.S. PATENT DOCUMENTS 3,441,268 A * 4/1969 Hanson ..... 271/210

FOREIGN PATENT DOCUMENTS

CA 000961520 A * 1/1975 ..... 271/3.05

* cited by examiner

*Primary Examiner*—Donald P. Walsh
*Assistant Examiner*—Kaitlin Joerger
(74) *Attorney, Agent, or Firm*—Michael J. Cummings; Charles R. Malandra, Jr.; Angelo N. Chaclas

(57) ABSTRACT

Envelope alignment of a vertical stack of envelopes in an envelope hopper is maintained by mechanically vibrating a preselected part of the hopper. In a first embodiment, the vibration is caused by a reciprocating shuttle having a wedge-shaped member attached to it. The reciprocating shuttle and wedge member are positioned at the bottom of the hopper so that the shuttle and wedge-shaped member support all of the envelopes. The reciprocation of the shuttle and hence the reciprocation of the wedge-shaped member continually jostles the envelopes. The wedge-shaped member ejects the lowermost envelope in the hopper when the reciprocating shuttle is displaced from a retracted position to an extended position. A motor is used to cause continuous reciprocation of the shuttle. In alternative embodiments, different parts of the envelope hopper are vibrated by any suitable vibration-causing member.

1 Claim, 4 Drawing Sheets

VIBRATING MEANS FOR ALIGNING ENVELOPES IN A HOPPER

CROSS-REFERENCE TO RELATED DISCLOSURES

This disclosure is a continuation-in-part of a disclosure filed by the present inventor on Nov. 14, 2000, application Ser. No. 09/712,716, entitled: "Vibrating Means For Aligning Envelopes In A Hopper," now pending.

BACKGROUND OF THE INVENTION

1. Field of the Invention

This invention relates, generally, to paper feeding accessory machines. More particularly, it relates to an envelope hopper of the type that is automatically replenished so that it remains substantially full and consistent in weight even when dispensing envelopes at a high rate of speed.

2 Description of the Prior Art

High volume machines for opening envelopes, inserting sheets into them, and closing the envelopes are in widespread use. These machines include envelope hoppers for storing a supply of envelopes to be opened. There are three primary types of envelope hoppers. One type includes a reciprocating horizontal support plate, or shuttle, positioned at the bottom of a hopper that discharges one envelope with each reciprocation. The envelopes in this type of hopper are disposed in a horizontal plane when in the hopper. Another type of hopper discharges envelopes when they are vertically disposed. A third type has continuous moving belts and relies on friction.

One of the most efficient means for filling an envelope hopper includes a horizontally disposed, elongate conveyor because large quantities of envelopes can be placed on the conveyor, thereby reducing the number of times a machine operator must replenish the envelope supply. Significantly, the conveyor supports the weight of the envelopes along its length. Accordingly, such arrangement is preferable to those prior art hoppers where a tall vertical stack of envelopes is placed in the hopper. A tall stack exerts significant weight upon the lowermost envelope. That is undesirable because the lowermost envelope is discharged from the hopper by an envelope discharging means which may require readjustment as the stack shortens and pressure on said discharging means reduces.

When an elongate, horizontal conveyor is used to support a long queue of envelopes entering a hopper, the bottom of the hopper is positioned in a horizontal plane a few inches below the conveyor so that the envelopes entering the hopper at the leading end of the conveyor follow a downwardly turned path of travel having a radius of curvature somewhat like that of water flowing over a low waterfall. More particularly, each envelope is in a vertical or substantially vertical disposition while on the conveyor, ie. , on its bottom longitudinal edge, with its flap facing away from the hopper toward which it is traveling. Upon arriving at an empty hopper, the first envelopes fall thereinto on their address-carrying sides, ie. , with their flaps facing upwardly. Thus, the envelopes in the hopper are in a horizontal plane. An operator will typically position the first supply of envelopes in the hopper so that said envelopes need not fall thereinto. The uppermost edges of the envelopes entering the hopper collectively form a round, downwardly turned profile at the entrance of the hopper as new envelopes gradually enter the hopper, rotating from their vertical disposition to their horizontal disposition, as envelopes are discharged from the bottom of the hopper by a suitable envelope discharging means. The speed of the conveyor is timed to supply a new envelope to the top of the short stack of envelopes in the hopper each time an envelope is removed from the bottom of the hopper for transportation to an envelope-opening means.

In this way, the height of the stack of envelopes in the hopper remains constant when the machine is operating. Significantly, this maintains the weight on the lowermost envelope at a constant value, thereby ensuring maximal operation of the envelope-discharging means.

Dispensing vertically stacked envelopes at a high rate of speed from an envelope hopper in a sequential fashion is problematic because the envelopes easily become misaligned from one another as they follow the downwardly turned path of travel. The hopper can become jammed or misfed because it requires each envelope being discharged from the bottom of the hopper to be in exactly the same position and orientation as the preceding envelope. It is customary in the industry to rely on a machine operator to jiggle or jostle the envelopes from time to time to maintain their alignment, but this labor-intensive solution is unacceptable. What is needed, then, is an automated way of vibrating the envelopes in an envelope hopper so that no human intervention is required.

However, in view of the prior art in at the time the present invention was made, it was not obvious to those of ordinary skill in the pertinent art how the identified needs could be fulfilled.

SUMMARY OF INVENTION

The longstanding but heretofore unfulfilled need for an improvement to an envelope hopper that maintains the alignment of the envelopes therein substantially in the absence of machine operator intervention is now met by a new, useful, and nonobvious invention. The novel envelope hopper is of the type that is continually filled with envelopes by a suitable hopper filling means. The hopper filling means includes an elongate, horizontally disposed conveyor means. The envelope hopper is positioned in longitudinal alignment with the conveyor means at a leading end thereof. The envelope hopper is positioned in a plane below the conveyor means so that envelopes entering into the envelope hopper from the conveyor means follow a downwardly turned path of travel. The envelope hopper includes an outboard and inboard wall means that are transversely spaced apart from one another by a distance slightly greater than an envelope length and a front and back wall means that are longitudinally spaced apart from one another by a distance slightly greater than an envelope width. The envelope hopper is adapted to hold a vertical stack of envelopes therein. A vibrating means is provided for imparting a continuous vibration to a preselected part of the envelope hopper so that vertical alignment of the vertical stack is maintained. The vibrating means makes physical contact with the preselected part of the envelope hopper. The preselected part may be the outboard wall means, the inboard wall means, the front wall means, the back wall means, or any other suitable part of the hopper.

In one embodiment of the invention, a shuttle is positioned at a lowermost end of the envelope hopper for supporting envelopes that are vertically stacked in the envelope hopper. An envelope-engaging member is secured to an upward-facing side of the shuttle, and the shuttle is mounted for reciprocation between a retracted position and an extended position. Means are provided for continuously reciprocating the shuttle between its retracted and extended positions. The envelope-engaging member makes physical contact with the envelope hopper for each reciprocation of the shuttle. In this way, the reciprocation of the shuttle imparts a vibration to the envelope hopper that maintains the envelopes in their vertical alignment.

The envelope-engaging member may take the form of a wedge-shaped member that has a raised outboard end and a lowered inboard end.

In embodiments that do not include a horizontally-disposed shuttle, such as hoppers that have bottom-mounted suction cups that sequentially remove the lowermost envelopes from the hopper, a vibration means is applied to any of the walls or posts that collectively maintain the envelopes in their vertically stacked configuration.

A primary object of the invention is to provide an automated means for maintaining envelope alignment in an envelope hopper of the type that dispenses envelopes at a high rate.

A closely related object is to provide such means that can be retrofit onto an existing conventional hopper to minimize the expense of such automated means.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF DRAWINGS

For a fuller understanding of the nature and objects of the invention, reference should be made to the following detailed description, taken in connection with the accompanying drawings, in which.

DETAILED DESCRIPTION

Figure 1:
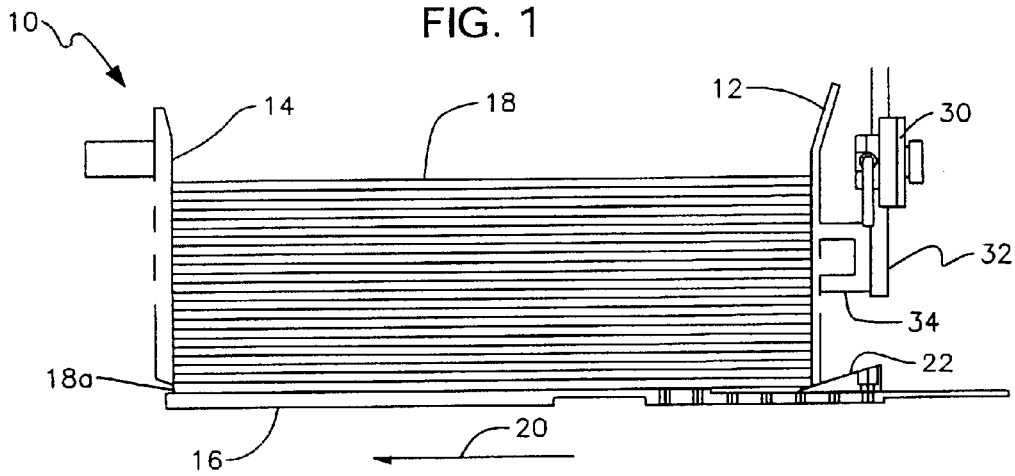
FIG. 1 is a front elevational view of an envelope hopper depicting the novel vibration means in a first, retracted position.
Figure 2:
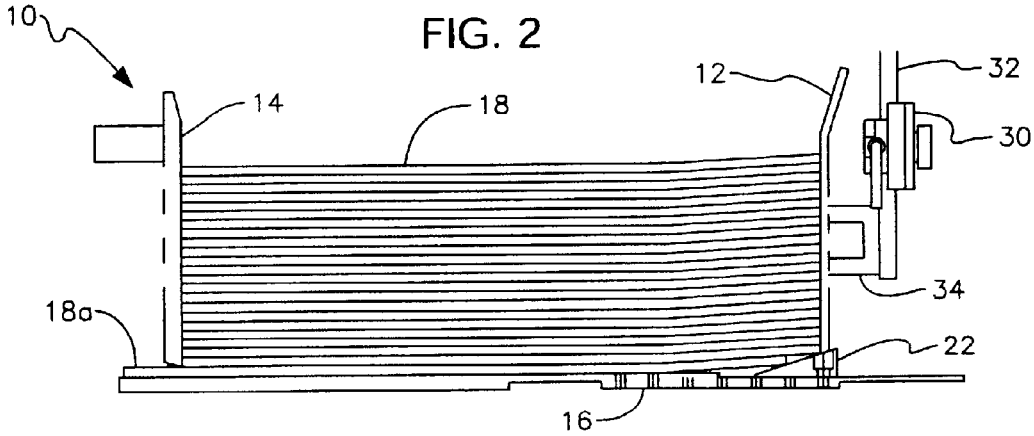
FIG. 2 is a front elevational view. depicting the novel vibration means in a second, intermediate position.
Figure 3:
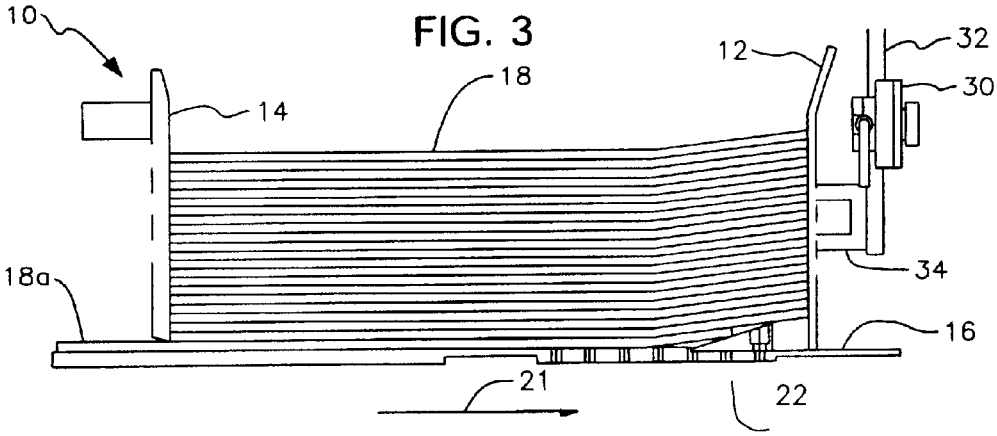
FIG. 3 is a front elevational view depicting the novel vibration means in a third, extended position.

Referring initially to FIGS. 1–3, it will there be seen that the reference numeral 10 denotes an illustrative embodiment of the present invention as a whole.

Hopper 10 includes upstanding outboard wall 12, upstanding inboard wall 14, and a front and back wall, not shown in FIGS. 1–3. Each wall 1 2, 14, as well as each unillustrated front and back wall, can be replaced by a pair of posts positioned in the plane of the wall they replace. Walls 12 and 14 are spaced apart from one another by a distance slightly greater than the length of an envelope. Similarly, the unillustrated front and back walls are spaced apart from one another by a distance slightly greater than a width of an envelope. In this way, the hopper has adequate tolerance to receive the envelopes as they enter thereinto. The dimensions of the hopper are changed as needed to accommodate envelopes of varying sizes.

In a first embodiment, a support plate or shuttle 16 is mounted for reciprocation in a horizontal plane at the lower end of hopper 10. A predetermined quantity of envelopes is denoted 18 and is supported by said shuttle 16. In embodiments having no shuttle 16, a suitable support means is provided to support the envelopes within the hopper. For example, as mentioned earlier, some envelope hoppers have suction cups positioned at the bottom thereof for supporting the envelopes and removing the lowermost one from the stack.

Shuttle 16 is mounted for oscillatory motion as is clear from a comparison of FIGS. 1–3 and as suggested by directional arrow 20 in FIG. 1 and 21 in FIG. 3. Shuttle 16 has a fully retracted position as depicted in FIG. 1 and a fully extended position as depicted in FIG. 3. FIG. 2 depicts an intermediate position.

Wedge member 22 is fixedly secured to shuttle 16 as depicted. When shuttle 16 is displaced from its FIG. 1 position to its FIG. 3 position, i.e., from its fully retracted position to its fully extended position, wedge member 22 is displaced conjointly therewith as is clear by comparing FIGS. 1, 2 and 3. As best understood from FIGS. 2 and 3, lowermost envelope 18*a* is carried atop shuttle 16 and is therefore displaced out of hopper 10 when shuttle 16 travels from its fully retracted to its fully extended position. Note that an end of the lowermost envelope is lifted from shuttle 16 as wedge member 22 travels into its fully extended position. this lifting of an end of the lowermost envelope also lifts the corresponding end of each of the other envelopes in the stack as best understood by comparing the unlifted envelopes of FIG. 1 with the lifted envelopes of FIGS. 2 and 3.-Upon fully exiting the hopper, each envelope is carried by a conveyor means, not shown, to an envelope-opening station, not shown.

wedge member 22 is raised at its outborad end with respect to its inborad end. of said this way, when shuttle 16 is retracted as depicted in FIG.1, the inborad end of said wedge member is almost fully retracted from the hopper so that lowermost envelope 18*a* is in almost full overlying relation to shuttle 16. Accordingly, the lowermost envelope and all envelopes above it are abruptly dropped when wedge member 22 is retracted.

Figure 4:
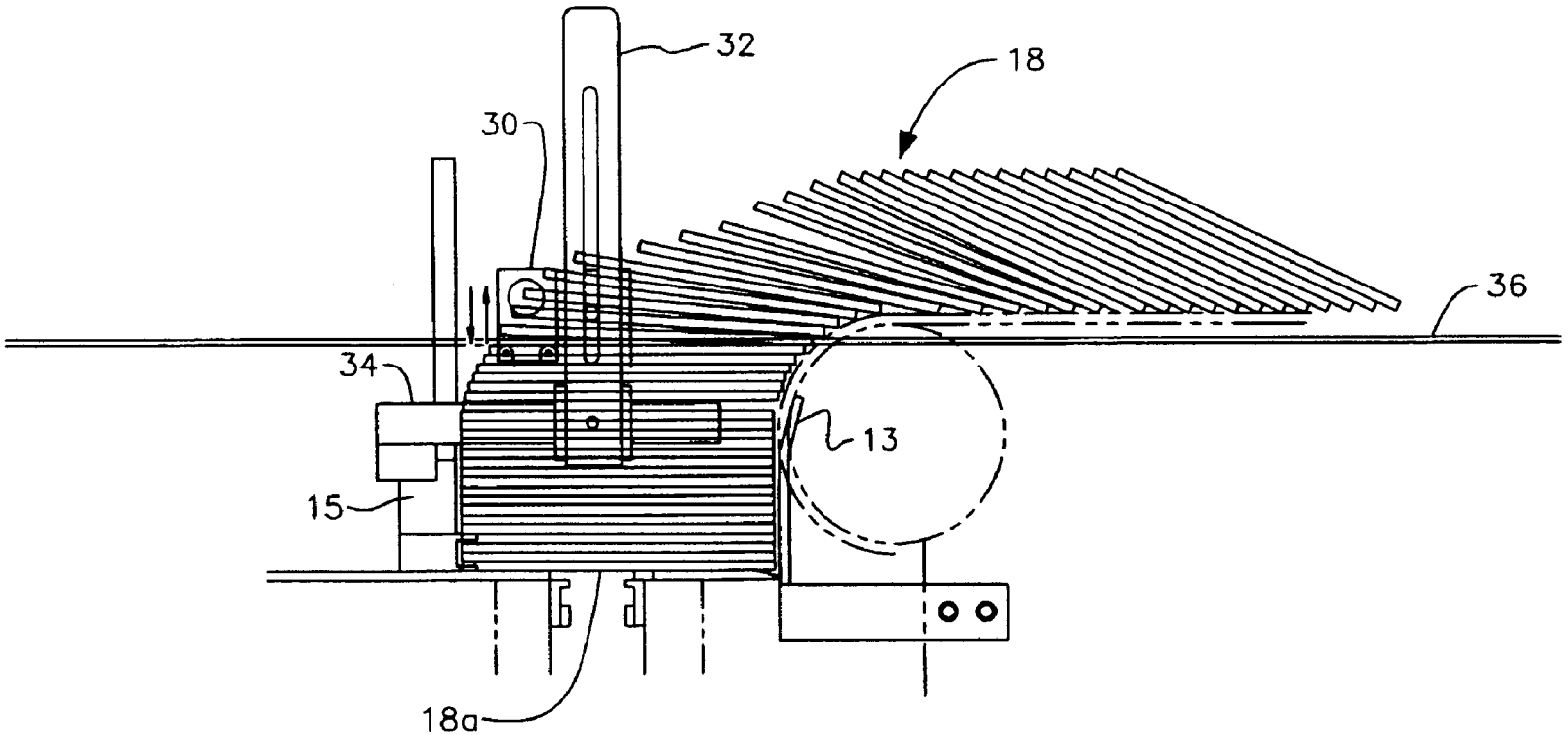
FIG. 4 is a side elevational view of the novel envelope hopper.

FIG. 4 provides a side view of the novel apparatus. Note back wall 13 and front wall 15, both of which may be replaced by a pair of coplanar posts as aforesaid. Reference numeral 30 denotes a photoelectric cell means that is vertically adjustable along the extent of slotted plate 32. Slotted plate 32 is horizontally adjustable along the extent of longitudinally disposed rod 34. In this way, photoelectric cell 30 can be positioned at a preselected height and longitudinal position as desired to maintain a replenishing supply of envelopes to the hopper, it being understood that said electric eye controls a motor, not shown, that controls longitudinally disposed conveyor means 36 that carries envelopes 18 to said hopper. Significantly, this maintains the height of the vertical stack of envelopes 18 in hopper 10 at a substantially uniform height so that the weight on lowermost envelope 18*a* and on shuttle 16 remains substantially the same as the envelopes are sequentially dispensed from the bottom of the hopper.

The means for oscillating shuttle 16 and hence wedge member 22 forms no part of this invention, per se . Any suitable oscillating means is acceptable. The rate of oscillation must be sufficiently high to cause a vibration of envelopes 18 that are in hopper 10. Such constant jiggling or jostling keeps them in alignment with one another so that jamming and misfeeding is avoided.

Clearly, wedge member 22 could have a different shape, i.e. , the wedge shape is not critical but it is preferred.

Figure 5:
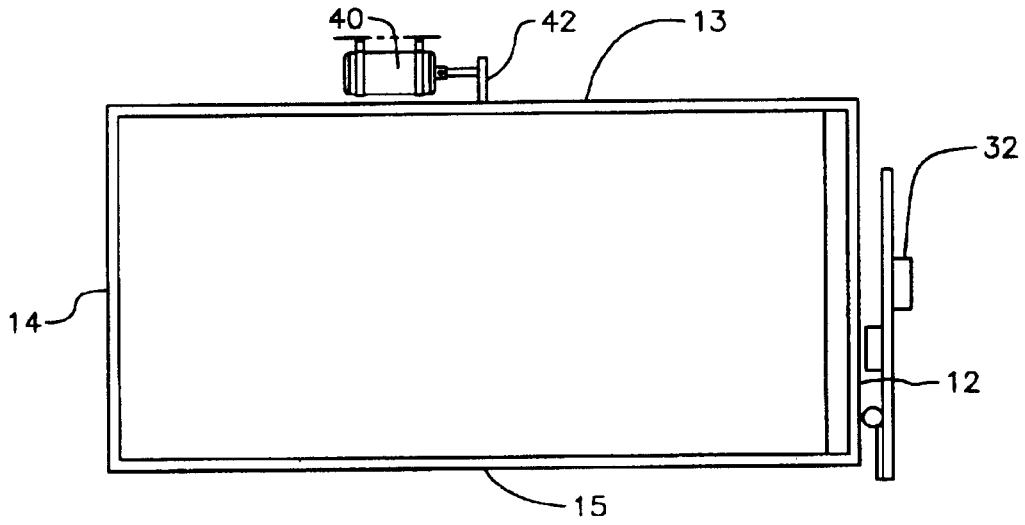
FIG. 5 is a top plan view depicting means for vibrating a back wall of said hopper.
Figure 6:
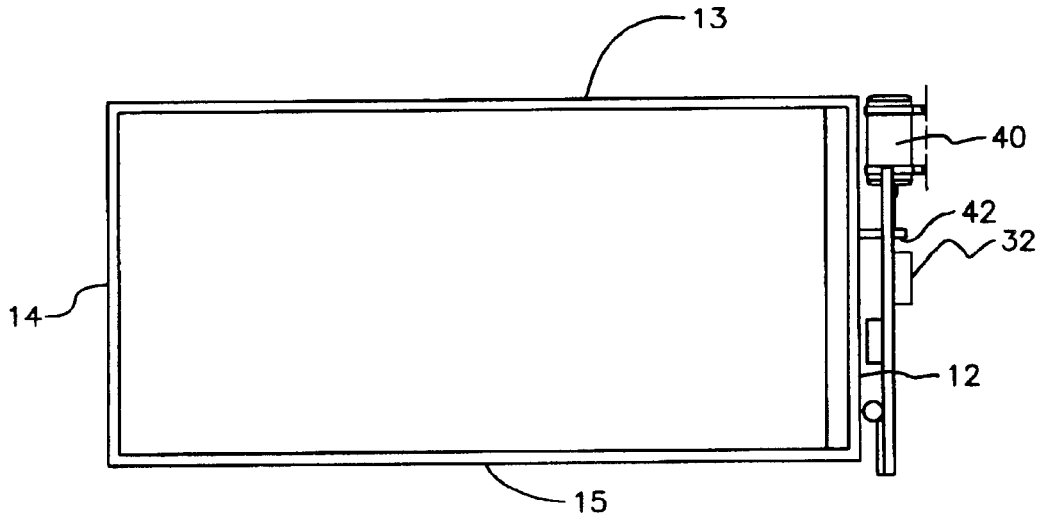
FIG. 6 is a top plan view depicting means for vibrating an outboard wall of said hopper.
Figure 7:
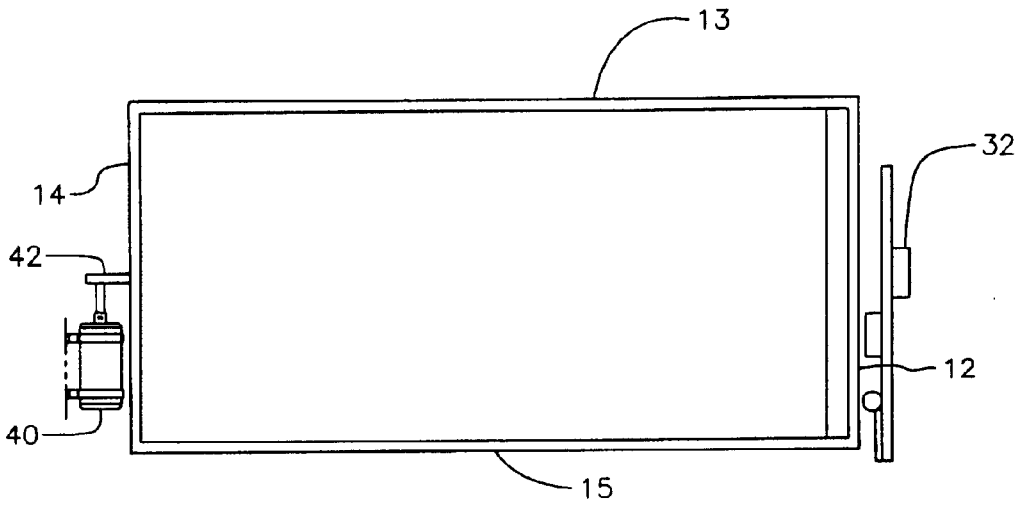
FIG. 7 is a top plan view depicting means for vibrating an inboard wall of said hopper.
Figure 8:
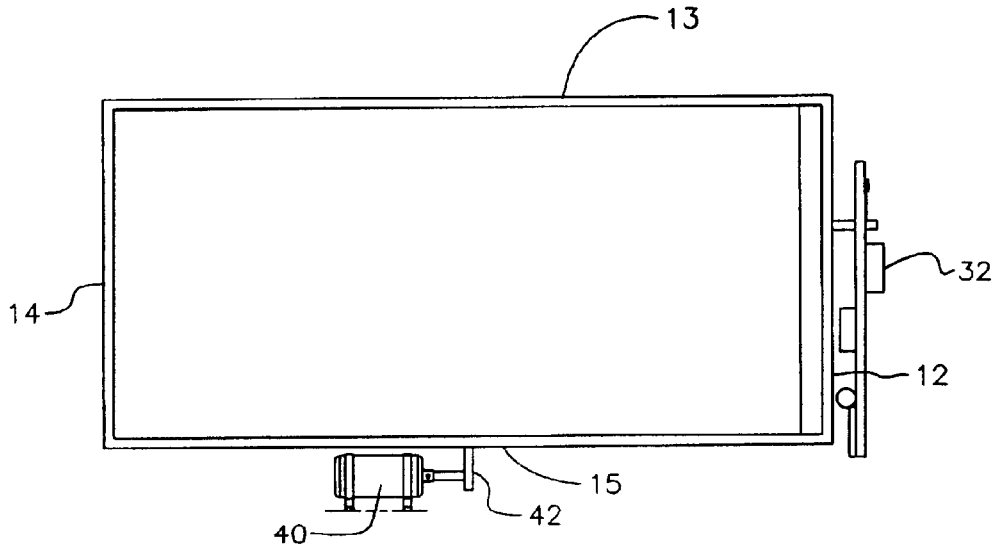
FIG. 8 is a top plan view depicting means for vibrating a front wall of said hopper.

Significantly, there are numerous other ways to impart a vibration to envelopes 18. In the illustrated embodiment, the vibration is provided incidentally by the oscillation of shuttle 16 and wedge member 22. In other words, shuttle 16 and wedge member 22 mounted thereon perform an envelope-dispensing function and hopper 10 is vibrated as an advantageous consequence thereof. However, any other means of vibrating hopper 10 is also within the scope of this invention. For example, any means for imparting vibration to outboard wall 12, inboard wall 14, back wall 13 or front wall 15, or their unillustrated equivalents (posts, e.g.) will have the same beneficial effect. A small motor 40, as depicted in FIG. 5, having a cam mounted on its output shaft, is mounted adjacent back wall 13 with the cam bearing against said wall so that said wall is vibrated as the motor operates. A similar vibration means is applied to outboard wall 12, as depicted in FIG. 6, inboard wall 14 as depicted in FIG. 7, front wall 15 as depicted in FIG. 8, or other part of hopper 10 as aforesaid. In the embodiments of said FIGS. 5–8, the vibrating means makes physical contact with the envelope hopper. The disadvantage of such an arrangement is that it requires dedication of a motor to the vibration task whereas the arrangement of the preferred embodiment produces "free" vibration, ie. as a side effect of the envelope-dispensing apparatus.

It could also be said that shuttle 16 and wedge member 22 make physical contact with the hopper because they form a part of said hopper but said parts do not necessarily physically contact the hopper walls during reciprocation of the shuttle.

It will be seen that the objects set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A device for vibrating envelopes in an envelope hopper, comprising:

an envelope hopper including an outboard and inboard wall means that are transversely spaced apart from one another by a distance slightly greater than an envelope length and a front and back wall means that are longitudinally spaced apart from one another by a distance slightly greater then an envelope width;

a shuttle positioned at a lowermost end of said envelope hopper for supporting envelopes that are vertically stacked in said envelope hopper;

a wedge-shaped envelope-engaging member having a raised outboard end and a lowered inboard end secured to an upward facing side of said shuttle;

said shuttle being mounted for reciprocation between a retracted position and an extended position;

means for continuously reciprocating said shuttle between said retracted and extended positions;

said wedge-shaped envelope-engaging member making physical contact with a lowermost envelope in said envelope hopper for each reciprocation of said shuttle;

each reciprocation of said wedge-shaped envelope-engaging member lifting and dropping an end of said lowermost envelope and all envelopes overlying it in said hopper so that an end of each envelope in said hopper is lifted and dropped as each envelope descends through said hopper.

* * * * *